United States Patent [19]

Geczy

[11] 4,299,296

[45] Nov. 10, 1981

[54] IN-HOLE MOTOR DRILL WITH BIT CLUTCH

[75] Inventor: Bela Geczy, Glendale, Calif.

[73] Assignee: Smith International, Inc., Newport Beach, Calif.

[21] Appl. No.: 55,373

[22] Filed: Jul. 6, 1979

[51] Int. Cl.[3] ..... E21B 4/00

[52] U.S. Cl. ..... 175/65; 175/101; 175/107

[58] Field of Search ..... 192/85 A; 175/106, 107, 175/39, 65, 101; 173/3

[56] References Cited

U.S. PATENT DOCUMENTS

| | | | |
|---|---|---|---|
| 2,167,019 | 7/1939 | Yost | 175/107 |
| 2,942,851 | 6/1960 | Beck | 175/107 |
| 3,982,859 | 9/1976 | Tschirky et al. | 175/107 |

FOREIGN PATENT DOCUMENTS

| | | | |
|---|---|---|---|
| 2521 | 10/1900 | Austria | 175/107 |
| 1244733 | 1/1960 | France | 175/107 |

*Primary Examiner*—William F. Pate, III

*Attorney, Agent, or Firm*—Philip Subkow; Bernard Kriegel

[57] ABSTRACT

An in-hole motor drill assembly has the rotor of the motor connected to the drill bit, and normally disengaged torque transmitting members are engageable, if desired, without changing the load on the bit, to lock the bit and motor housing together for rotation of the bit by rotation of the motor housing.

23 Claims, 8 Drawing Figures

IN-HOLE MOTOR DRILL WITH BIT CLUTCH

BACKGROUND OF THE INVENTION

In the drilling of bore holes into or through earth formation, such as, for example, in the drilling of oil or gas wells, utilizing a rotary drill bit, it may occur, from time to time, that the bit may be stuck in the earth formation or debris in the bore hole, either due to the caving in of the bore hole wall, or due to the formation of a key seat in the hard earth formation. When the bit is stuck, under such circumstances, it is difficult, if not impossible, to pull the drill string and bit from the bore hole. In the case of drilling by the usual rotary method, wherein the drill bit is attached to the lower end of a rotary string of drill pipe, it is the practice to rotate the drill pipe by the usual rotary table, as an upward pull is being applied to the drill pipe, to assist in the release of the stuck bit.

In the case of in-hole motor drill assemblies of the electrical or fluid motor types wherein the rotary drill bit is driven by the in-hole motor interposed between the running string and the bit, it is not, as a rule, possible to cause the bit to rotate by rotation of the running or drill pipe string or fluid conduit above the motor. The reaction torque of such in-hole motors is, generally, taken by a rotary table at the surface of the bore hole, whereby the drill pipe string can either be held stationary or, if desired, rotated to obviate the wedging of the string. However, if the bit becomes stuck in the bore hole, such in-hole motors will stall and continued rotation of the bit may not be possible, notwithstanding the availability of additional drilling fluid pressure or electromotive force. When such motor drills are stalled in the bore hole, rotation of the drill pipe string by the rotary table is ineffective to cause bit rotation, since there is no positive drive between the stator and the rotor and the bit remains wedged, or stuck, in the hole. As a consequence, when an in-hole motor drill has the drill bit stuck in the bore hole, an attempt can be made to pull the running pipe string and the motor drill from the bore hole, without rotating the bit, and various jarring devices have been utilized in the drill pipe string to assist in applying upward jarring forces to the drill pipe string and to the bit, in an effort to dislodge the latter.

In the event that the bit remains stuck, the practice has been to break the drill pipe joint above the motor drill assembly, if possible, in a known manner, whereby the drill pipe string can be retrieved to the drilling rig and, thereafter, to sidetrack the bore hole around the motor and bit which remain in the hole. Such practices result in great losses in time and costs.

Pending application Ser. No. 957,179, filed Nov. 2, 1978, now U.S. Pat. No. 4,232,751 by Trzeciak, relates to an in-hole motor drill apparatus, wherein the rotor of the motor is connected to the drill bit by a rotary drive connection, including torque transmitting members, which can enable the stator or housing of the motor, in the event that the bit becomes stuck in the hole, to positively transmit torque to the bit, in response to rotation of the drill pipe string.

In a specific form the torque transmitting members interlock to enable the application of pulling force to the bit as it is rotated by the pipe string in one direction.

More particularly, a normally disengaged rotary clutch is provided between the motor housing and the bit and is engaged when weight is applied through the motor housing, by the drill pipe string, in excess of that normally applied during the drilling of the bore hole. In this connection, it will be understood that the progression of the bore hole, as the bit rotates, during normal drilling operations, is dependent upon the thrust or weight applied to the cutting elements of the bit through the motor housing, such weight being transmitted to the in-hole motor drive shaft through a bearing which supports the drive shaft within the motor housing for rotation.

However, if the bit is stuck in soft formation, the application of additional weight may interfere with efforts to release the bit because the bit is forced deeper into the formation in which it is stuck.

SUMMARY OF THE INVENTION

The present invention relates to the provision of a clutch for connecting the drive shaft of an in-hole motor to the housing for joint rotation by rotation of the running pipe string, wherein the clutch can be engaged, when desired without adding weight to the bit. Thus, the possibility of releasing the bit by the combination of rotating and pulling on the pipe string is enhanced.

More particularly, the invention contemplates automatically connecting the bit to the running pipe string for mutual rotation in response to changing the differential pressure in the motor drill and in the annulus outside the motor drill.

As specifically illustrated herein, the housing and drive shaft may be interconnected for rotation by clutches which are disengaged by fluid pressure supplied during the circulation of drilling fluid through an in-hole motor and through the bit, to flush cuttings from the borehole, as drilling progresses and engaged when the flow of drilling fluid is reduced.

Engagement of the clutch, without adding weight to the bit can also be accomplished by a structure which operates, mechanically, in response to movement of the housing upwardly relative to the stuck bit, or automatically upon rotation of the housing in the direction in which the motor drives the shaft. Such structure operable in response to longitudinal movement of the housing is, specifically, the subject of my application for patent filed Aug. 20, 1979 Ser. No. 067,862. Such structure operable automatically by rotation of the housing is, specifically, the subject of my application for patent filed Aug. 20, 1979, Ser. No. 067,822.

The structures of the present application accomplish the objective of engaging the clutch, without adding weight to the bit, by utilizing clutches which are held disengaged responsive to the circulation of drilling fluid through a bearing assembly for the bit or the nozzles of a bit into the annulus outside of the drilling apparatus. Ignoring dynamic pressures and friction, this differential pressure is essentially the difference between hydrostatic pressure in the annulus and applied pump pressure to force fluid through the nozzles of the drill bit.

More specifically the invention, as herein illustrated involves the application of fluid pressure disengaged clutches which have actuators or motors subjected to the pressure of drilling fluid flowing through the bearing assembly for the shaft, which includes flow restrictors for limiting the portion of the total volume of fluid which can flow through the bearing assembly, to prevent excessive fluid bypass of the bit.

In my companion application Ser. No. 067,756, filed Aug. 20, 1979, fluid actuated devices which hold clutches disengaged utilize the pressure of fluid flowing through the shaft to the bit.

All of the above referred to structures have the advantage that means are provided to engage and disengage the clutch without increasing the thrust load on the bit. The devices of the present application and my companion application Ser. No. 67,756 are automatic, in the sense that the clutches are engaged or conditioned for engagement automatically upon cessation of the flow of drilling fluid, when the pump is shut down, or when flow through the motor is interrupted by the opening of a circulation valve of the type shown, for example, in Emery application Ser. No. 047,296, thereby enabling circulation of drilling fluid through the annulus above the motor and reducing the differential pressure which holds the clutch disengaged, to enable engagement of the clutch.

This invention possesses many other advantages, and has other objects which may be made more clearly apparent from a consideration of several forms in which it may be embodied. Such sorms are shown in the drawings accompanying and forming part of the present specification. These forms will now be described indetail for the purpose of illustrating the general principles of the invention; but it is to be understood that such detailed description is not to be taken in a limiting sense.

DESCRIPTION OF THE PREFERRED EMBODIMENTS

Figure 1:
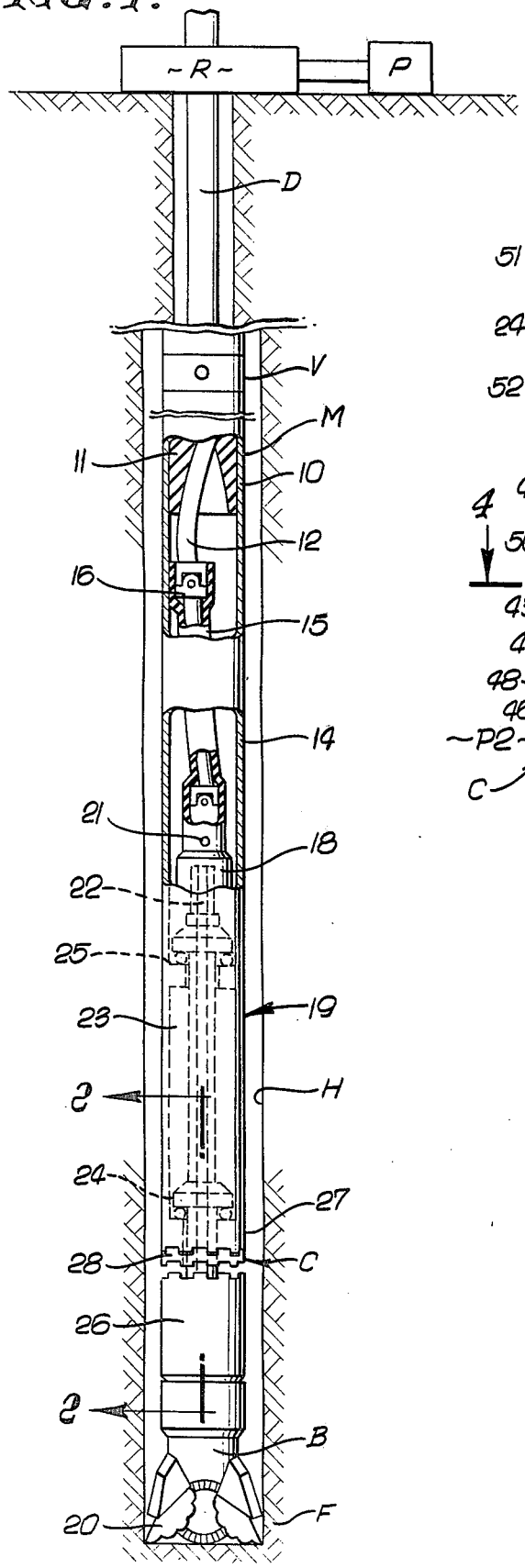
FIG. 1 is a view diagrammatically showing an in-hole motor drill, partly in elevation and partly in section, in an earth bore hole, and incorporating a clutch structure in accordance with the invention.

As seen in the drawings, referring first to FIG. 1, an in-hole motor assembly M is connected to the lower end of a string of drilling fluid conducting drill pipe D and has its housing 10 providing a progressing cavity stator 11 for a rotatable helicoidal rotor 12. The illustrative motor is a positive displacement-type fluid motor of a known type. The rotor is driven by a downward flow of fluid supplied to the pipe string from the usual pump P provided on a drilling rig having a rotary R which can rotate the pipe D which is suspended by the usual drilling lines of a derrick or rig (not shown). The fluid passes downwardly through a connecting rod housing section 14 which contains a connecting rod assembly 15, connected by a universal joint 16 to the lower end of the rotor 12 and by a universal joint 17 to the upper end of the drive shaft 18. The drive shaft extends downwardly through a bearing assembly 19, and at its lower end, the drive shaft is connected to a drill bit B, having cutters 20 adapted to drill through the earth formation F, in the drilling of a bore hole H. The drive shaft 18 is tubular and has, adjacent its upper end, inlet ports 21, through which the drilling fluid passes from the connecting rod housing 14 into the elongated central bore 22 of the drive shaft, the fluid exiting from the bit B to flush cuttings from the bore hole and cool the bit.

During operation of the fluid motor M, the lower end of the rotor 12 has an eccentric motion which is transmitted to the drive shaft 18 by the universal connecting rod assembly 15, and the drive shaft 18 revolves about a fixed axis within the outer housing structure 23 of the bearing assembly 19, the drive shaft being supported within the housing by bearing means 24 and 25 shown in broken lines in FIG. 1. Such bearing means are well known and take various forms, an example of which is shown in U.S. Pat. No. 4,029,368 granted to Tschirky et al for Radial Bearings.

The bearing assembly of that patent is mud lubricated and a certain amount of the total volume of the circulating fluid is allowed to flow through the bearings, at a rate determined by flow restrictor sleeves, due to the differential pressure caused by the restricted flow of the majority of the circulating or drilling fluid through the bit nozzles, as is well known. The bearings of that patent and all the bearings assemblies of the same general type have set down bearings to transmit axial load from the drill string to the bit, through the drive shaft, and pick-up or off bottom bearings by which the bit is pulled from the hole, when the drill string is pulled.

In the case of the bearings 24 and 25, generally illustrated in FIG. 1, the bearing 24 is a pick up bearing while the bearing 25 is the set down bearing, as will be well understood and as will be more fully described below.

The invention provides a clutch C between an enlarged lower end 26 of the shaft 18 and the lower end of the housing 27 of the bearing assembly 19. In the form shown in FIGS. 1 through 4, the clutch C is normally engaged, but is adapted to be disengaged when drilling fluid is being pumped down the drill pipe string D by the pump P. The clutch includes a drive member 28 and a driven member formed by the lower end of the shaft 18, adapted to be rotatably driven by rotation of the housing structure, when the clutch is engaged. The drive member 28 is an annular member having a number of circumferentially spaced downwardly projecting lugs or torque transmitting members 29 adapted to interfit with companion, circumferentially spaced lugs or torque transmitting members 30 on the lower end 26 of the drive shaft 18. The drive ring 28 is in torque transmitting and axially shiftable relation to the housing 27 by means of a number of upwardly facing, circumferentially spaced lugs 31 on the drive ring 28 and companion downwardly facing and circumferentially spaced lugs 32 on the lower end of the housing 27. As clearly seen in FIG. 1, the respective torque transmitting members or lugs 29, 30, 31 and 32 have opposing drive surfaces which extend radially and project axially of the assembly, whereby when the clutch is engaged, as seen in FIG. 3, torque can be transmitted in either direction. However, as is well known, it is customary to transmit torque through a drill pipe string in a right-hand direction, which is the direction of make up of the usual threaded connections in the drill pipe string.

The actuator means for the clutch C, in the embodiment of FIGS. 1 through 4, includes an annular actuator body 33, disposed in the inner bore 34, adjacent the lower end of the housing and seating on a upwardly facing shoulder 35 in the housing. The actuator body 33 is suitably keyed to the housing for rotation therewith, as by a suitable number of pins 36 which are engaged at the lower end of the actuator body 33. Preferably, a side ring seal 37 is disposed between the outer periphery of the actuator body 33 and the bore within the body to prevent the bypass of fluid about the exterior of the body, so that fluid flowing downwardly in the housing space between the shaft and the housing 27 is caused to flow through a restricted gap 38, which is defined between the inner periphery 39 of the actuator body 33 and the other periphery 40 of a sleeve 41 which is keyed at 42 to the shaft 18 for rotation therewith.

The gap 38 between the actuator body 34 and the sleeve 41 is designed to restrict the flow of fluid from the housing, when fluid is being circulated by the pump P, to a relatively small amount, as compared with the gross volume of circulating fluid, the bulk of which flows through the usual bit orifices, causing, during circulation, a pressure differential, which will be later described. The actuator body 33 and the sleeve 41 can be constructed, if desired, according to the above-identified U.S. Pat. No. 4,029,368, to also function as a radial bearing, but in the illustrative embodiment the structure has been shown in a simple form and the gap 38 between the opposing surfaces 39 and 40 has been exaggerated for clarity.

Provided in the actuator body 33 are a suitable number of circumferentially spaced bores or cylinders 43, each containing an actuator piston 44 having a rod 45 extending through the lower end wall of the bearing housing 27 and being threadedly engaged at 46 in the clutch drive ring 28. Above the pistons 44 is a coiled compression spring 47 which normally acts downwardly upon the piston 44, thereby providing a downward force on the clutch drive ring 28, fluid pressure is applied to the piston chamber 48 below the actuator piston 44 from the housing 27 via a passageway 49, which, at its upper end, is in communication with the housing. On the other hand, fluid in the annular bore hole space externally of the housing is applied to the upper side of the piston 44 by a suitable passage-way 50.

The bearing assembly 24 comprises an upper race 51 locked by suitable means 52 on the shaft for rotation therewith, and a lower race 52 is carried within the housing, and has downwardly extending lugs 53 engaging with companion upwardly facing lugs 54 on the upper end of the actuator body 33, whereby the lower bearing race 52 revolves with the housing. Suitable balls or other bearings 55 are disposed between the races, so that as seen in FIG. 2, when the housing structure, including the bearing housing 27 is subjected to an upward pull, thrust is transmitting from the housing to the shaft to the bearing assembly 24, which, in the illustrative embodiment includes a spring or springs 56 shown as a pair of Belvelle springs, disposed between a downwardly facing shoulder 57 on the lower bearing race 52 and an upwardly facing shoulder 58 provided by the actuator body 34, whereby the pick up bearing assembly 54 is spring loaded.

Figure 2:
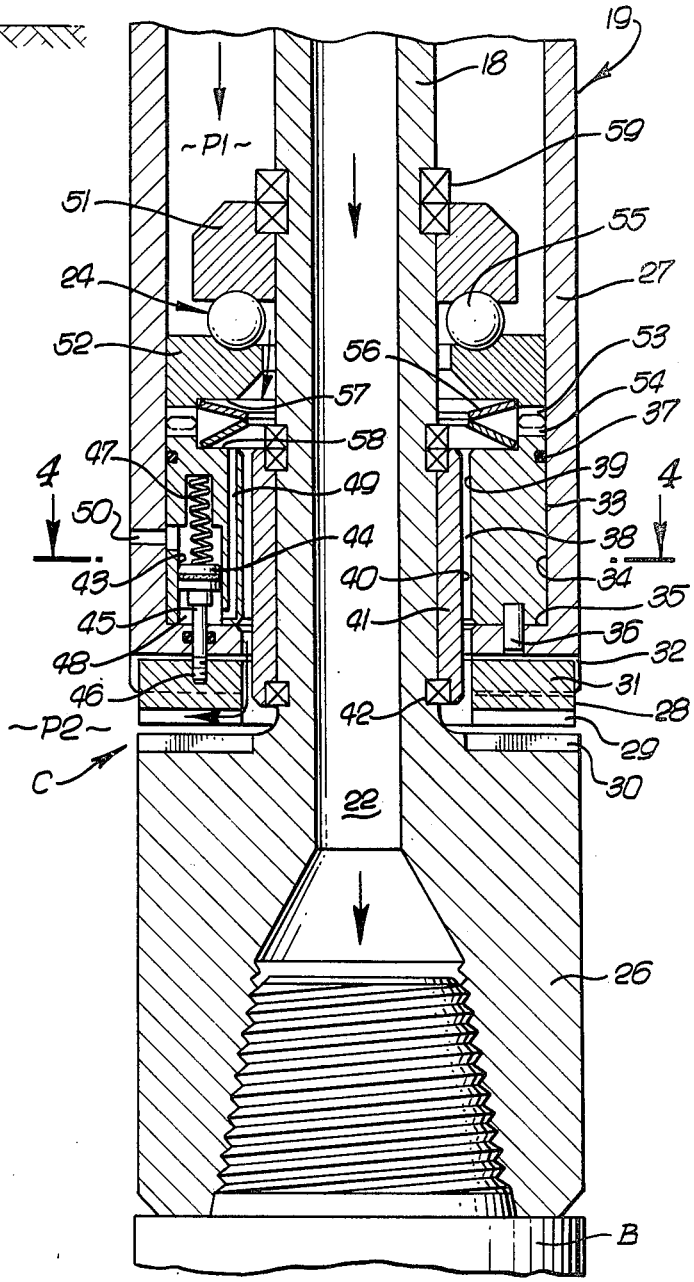
FIG. 2 is an enlarged, fragmentary, longitudinal section, as taken on the line 2—2 of FIG. 1, showing one embodiment of the clutch disengaged.
Figure 3:
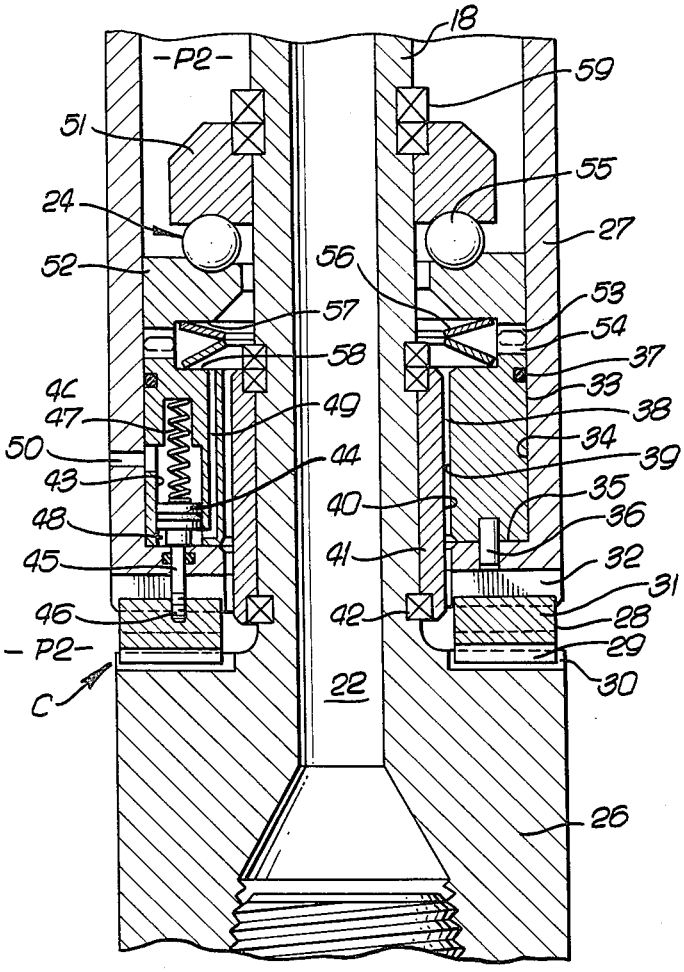
FIG. 3 is a view corresponding with FIG. 2, but showing the clutch engaged.

As seen in FIG. 2, and indicated by the arrows, fluid is being pumped downwardly through the bore 22 of the shaft 18, and thus will exit through the bit orifices, causing a pressure differential. The pressure in the housing between the shaft and the housing, which thus flows through the restricted path 38 will be at a pressure P1, while the pressure externally of the housing is at a lower pressure P2, the latter being essentially the hydrostatic pressure of fluid in the annulus, and the former being substantially the same hydrostatic pressure plus the pressure differential caused by the flow restrictors, when the pump is operating. The pressure P1 is applied through the passageway 49 to the underside of the actuator piston 44, urging the actuator piston 44 upwardly, against the downward bias of the spring 47, so that the clutch drive ring 28 will be in the elevated position of FIG. 2, and therefore, the clutch remains disengaged, so long as the pump is operating to circulate fluid through the flow restrictor.

However, when the circulation of fluid downwardly through the flow restrictor ceases or is reduced, the pressure in the housing between the housing and the shaft and externally of the housing are both at hydrostatic pressure P2, at which time the spring 47 can act to positively move the clutch drive ring 28 downwardly, so that the lugs thereon are adapted to interfit with the lugs on the enlarged lower end of the drive shaft 18. In the event that the lugs on the drive ring and on the shaft should not initially interfit, the springs can force the lugs into interfitting engagement upon initial rotative movement of the housing.

As best seen in FIG. 3, the drive lugs on the lower end of the housing and on the clutch drive ring remain in engagement when the clutch is engaged with the shaft, so that a positive drive connection exists between the housing and the shaft, without transmitting torque through the rods of the respective actuator pistons. Thus, torque is directly transmitted from the housing to the bit, enabling the housing to be rotated to rotate the bit as an upward pull is being applied to the housing, and through the pick up bearing 24 to the bit, in an effort to release the stuck bit. This is accomplished without adding any weight to the bit, through the housing, and indeed, without changing the load on the bit. When the circulation of fluid is resumed, the pump pressure is again applied to the hydrostatic pressure in the space between the bearing housing 27 and the shaft, increasing the pressure to the pressure P1, so that the actuator pistons will be actuated upwardly to disengage the clutch. If the bit has been freed, then the flow of fluid through the motor can cause rotation of the bit, but if the bit remains stuck, the pumps can be shut down and the clutch will again re-engage enabling further rotation of the bit by rotation of the drill pipe string.

Figure 5:
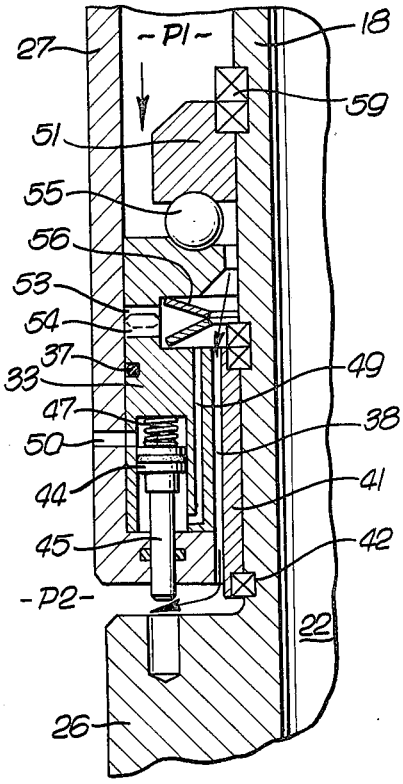
FIG. 5 is a fragmentary longitudinal section showing another embodiment of the clutch, with the clutch disengaged.
Figure 4:
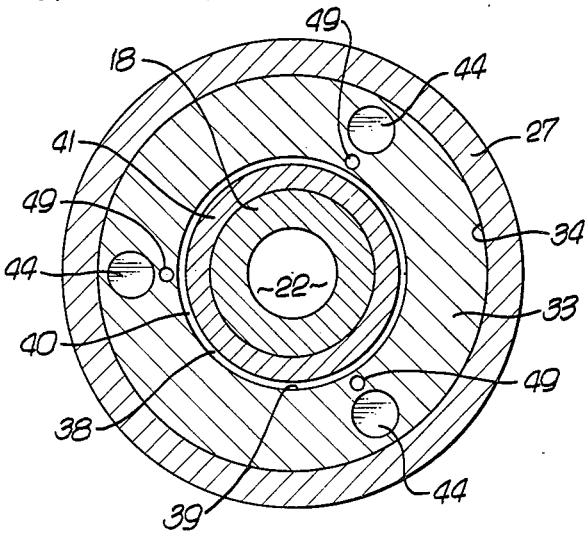
FIG. 4 is a transverse section on the line 4—4 of FIG. 2.
Figure 6:
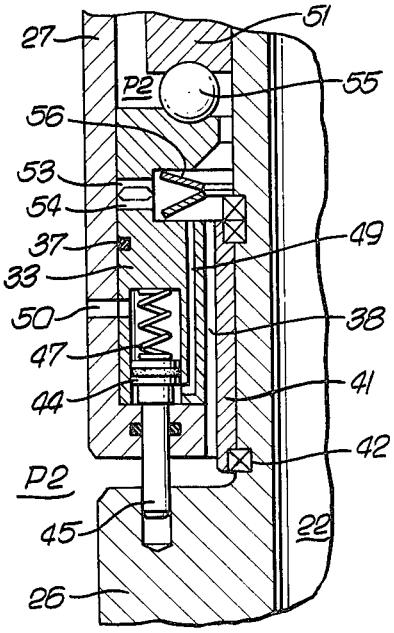
FIG. 6 is a view corresponding with FIG. 5, but showing the clutch engaged.

Referring to FIGS. 5 and 6, a somewhat modified construction is illustrated, wherein the arrangement of the bearing, the actuator body, the inner flow restricting sleeve, and bearing loading springs is the same as that illustrated in FIGS. 1 through 4. In this modified construction, however, the piston rods 45 are adapted to be projected downwardly for engagement in sockets in the enlarged lower end 26 of the drive shaft, under the influence of the springs 47, so that when the pressure P1 in the space between the shaft 18 and the housing 27 overcomes the force of the springs and the external pressure P2, the pistons remain retracted, as seen in FIG. 5. However, when the internal pressure is reduced to P2, a pressure more or less equalling the external pressure P2, then the springs 47 can project the piston rods downwardly for engagement in the companion sockets, at which time the housing can be rotated to rotate the bit.

Figure 7:
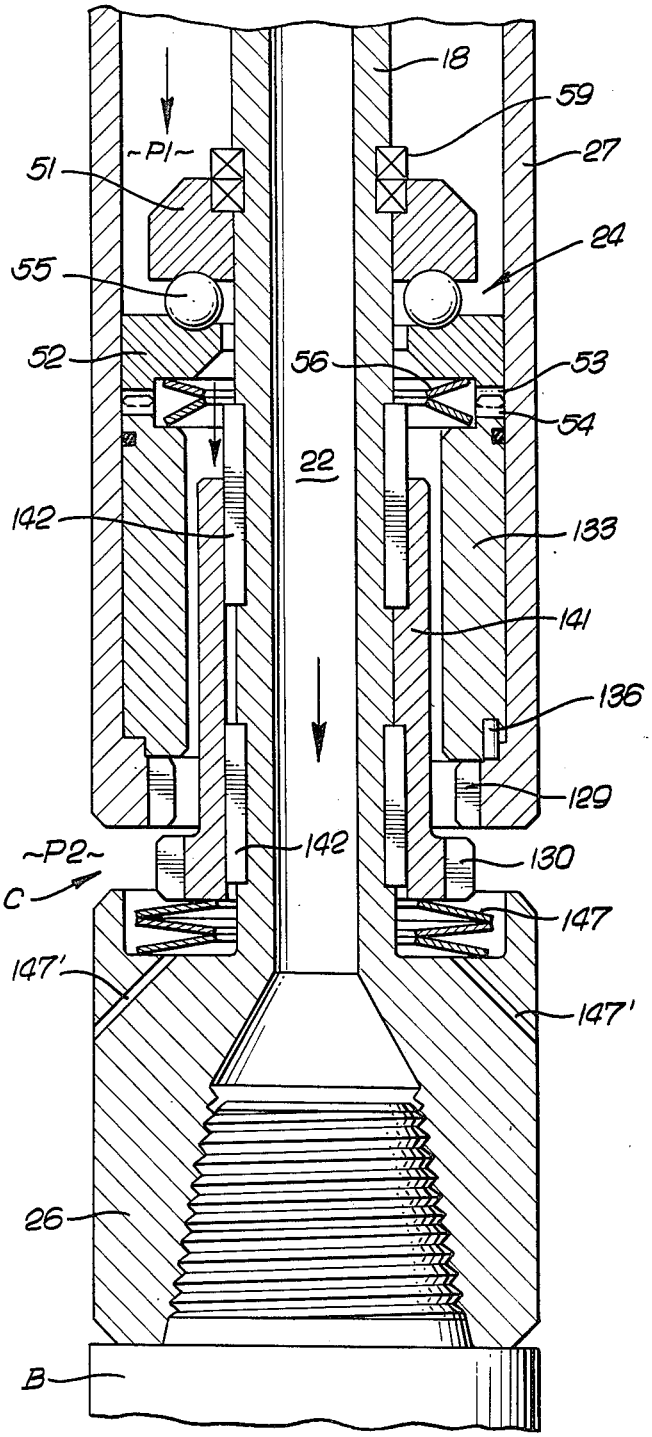
FIG. 7 is a fragmentary section showing another embodiment of a clutch, with the clutch disengaged.
Figure 8:
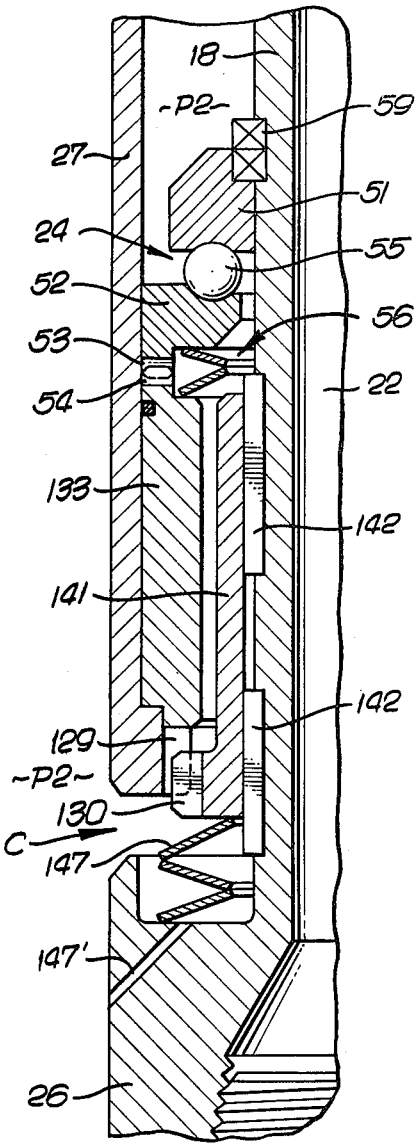
FIG. 8 is a view corresponding with FIG. 7, but showing the clutch engaged.

As seen in FIGS. 7 and 8, a further modified construction is illustrated, wherein one of the flow restricting sleeves is axially shiftably movable upon the shaft to maintain the clutch C disengaged so long as the fluid is being circulated through the shaft, or through the space between the shaft and the housing, if the bit is plugged.

In this construction, the bearing means 24 is essentially the same as that previously described. The lower bearing race 52 is connected with the lower flow restricting sleeve or body 133 by means of lugs 53 and 54 on respective bearing race and flow restrictor sleeve, and the sleeve 133 is pinned or otherwise keyed to the housing, for rotation therewith, as by a pin 136, adjacent the lower end of the housing 27, and internally of the lower flange thereon, the housing has torque transmitting members in the form of gear teeth or lugs 129 which are circumferentially spaced and extend longitudinally within the lower end of the housing 27. The inner flow restricting sleeve 41 has companion clutch teeth 130, circumferentially spaced about the lower end thereof and engageable with the teeth 129 in the housing under the influence of suitable spring means, such as Belleville springs 147 which are engaged in a spring seat provided in the enlarged lower end of the drive shaft. If desired, suitable ports 147' can be provided to prevent the entrapment of fluid within the seat for the springs 147. The flow restrictor sleeve 141 is suitably keyed or has a spline connection at 142 with the drive shaft 18, so that the sleeve 141 will rotate with the shaft and when the clutch seat is engaged, the housing can cause rotation of the shaft.

As illustrated in FIG. 7, when fluid is being circulated and the pressure P1 in the housing, between the housing and the shaft, exceeds the pressure P2 in the annulus, there is a differential pressure acting across the flow restrictor sleeve 141, which provides a downward force which can overcome the upward force of the springs. However, when the circulation is interrupted, and the pressure in the housing between the housing and the shaft is at pressure P2, and the pressure in the annulus is also P2, then the upward bias of the springs 147 will shift the flow restrictor sleeve 141 upwardly, as seen in FIG. 8, causing engagement of the torque transmitting members 129 and 130 of the clutch means C.

The pressure P1 applicable to the clutch actuators or motors can also be reduced to approximately P2 by opening a valve V above the motor to enable the continued circulation of drilling fluid through the annulus, above the motor, to flush the bore hole in accordance with my companion application, Ser. No. 55,690. In any event, if the pressure P1 is reduced to produce a force tending to hold the clutch disengaged which is less than the spring force tending to engage the clutch, the clutch will be engaged.

Other arrangements of parts responsive to the differential between the pressure P1 and P2, when the pumps are operating, to maintain the clutch in a disengaged condition will be become apparent in the light of the foregoing. As pointed out above, devices which do not change the load on the bit to engage the clutch can be mechanically operated or operated hydraulically by fluid flowing through the bore 22 of the shaft.

I claim:

1. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft; fluid passageways through said shaft, bearings between said shaft and said housing to transmit thrust; a fluid passageway through said bearings and said housing; a clutch engageable between said housing and said shaft to couple said housing to a bit for joint rotation; and means to engage and disengage said clutch without increasing the thrust load on said shaft at said other end, said means including a flow restrictor in said housing, said means to engage and disengage said clutch being operable without changing the thrust load on said shaft.

2. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft; fluid passageways through said shaft, bearings between said shaft and said housing to transmit thrust; a fluid passageway through said bearings and said housing; a clutch engageable between said housing and said shaft to couple said housing to a bit for joint rotation; and means to engage and disengage said clutch without increasing the thrust load on said shaft at said other end, said means including a flow restrictor in said housing, said means to engage said clutch including a spring normally acting to engage said cluth, said means to disengage said clutch being responsive to the flow of fluid from said pipe string.

3. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft, fluid passageways through said shaft, bearings between said shaft and said housing to transmit thrust; a fluid passageway through said bearings and said housing; a clutch engageable between said housing and said shaft to couple said housing to a bit for joint rotation; and means to engage and disengage said clutch without increasing the thrust load on said shaft at said other end, said means including a flow restrictor in said housing, said means to engage said clutch including a spring normally acting to engage said clutch, said means to disengage said clutch being responsive to a difference in fluid pressure in said housing and externally of said housing.

4. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft; fluid passageways through said shaft, bearings between said shaft and said housing to transmit thrust; a fluid passageway through said bearings and said housing; a clutch engageable between said housing and said shaft to couple said housing to a bit for joint rotation; and means to engage and disengage said clutch without increasing the thrust load on said shaft at said other end, said means including a flow restrictor in said housing, said clutch comprising relatively shiftable members engageable between said shaft and said housing, and a spring biasing one of said members towards the other.

5. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft; fluid passageways through said shaft, bearings between said shaft and said housing to transmit thrust; a fluid passageway through said bearings and said housing; a clutch engageable between said housing and said shaft to couple said housing to a bit for joint rotation; and means to engage and disengage said clutch without increasing the thrust load on said shaft at said other end, said means including a flow restrictor in said housing, said clutch including a drive ring driven by one of said housing and said shaft and a spring biasing said ring into engagement with the other end of said housing and said shaft.

6. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft; fluid passageways through said shaft, bearings between said shaft and said housing to transmit thrust; a fluid passageway through said bearings and said housing; a clutch engageable between said housing and said shaft to couple said housing to a bit for joint rotation; and means to engage and disengage said clutch without increasing the thrust load on said shaft at said other end, said means including a flow restrictor in said housing, said clutch including a drive ring, driven by one of said housing and said shaft and a spring biasing said ring into engagement with the other of said housing and said shaft, said means to disengage said clutch including differential fluid pressure operated actuator means operable when fluid flows through said pipe string.

7. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft; fluid passageways through said shaft, bearings between said shaft and said housing to transmit thrust; a fluid passageway through said bearings and said housing; a clutch engageable between said housing and said shaft to couple said housing to a bit for joint rotation; and means to engage and disengage said clutch without increasing the thrust load on said shaft at said other end; said means including a flow restrictor in said housing, said clutch including rods carried by one of said housing and said shaft, and sockets in the other of said housing and said shaft.

8. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft; fluid passageways through said shaft, bearings between said shaft and said housing to transmit thrust; a fluid passageway through said bearings and said housing; a clutch engageable between said housing and said shaft to couple said housing to a bit for joint rotation; and means to engage and disengage said clutch without increasing the thrust load on said shaft at said other end, said means including a flow restrictor in said housing, said clutch including rods carried by one of said housing and said shaft, and sockets in the other of said housing and said shaft, said means to disengage said clutch including differential fluid pressure operated actuator means operable when fluid flows through said stator.

9. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft; fluid passageways through said shaft, bearings between said shaft and said housing to transmit thrust; a fluid passageway through said bearings and said housing; a clutch engageable between said housing and said shaft to couple said housing to a bit for joint rotation; and means to engage and disengage said clutch without increasing the thrust load on said shaft at said other end, said means including a flow restrictor in said housing, a flow restrictor in said housing defining a restricted flow path in said housing, said means for disengaging said clutch being operable by the difference in pressure caused by said restricted path when fluid is flowing therethrough.

10. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft; fluid passageways through said shaft, bearings between said shaft and said housing to transmit thrust; a fluid passageway through said bearings and said housing; a clutch engageable between said housing and said shaft to couple said housing to a bit for joint rotation; and means to engage and disengage said clutch without increasing the thrust load on said shaft at said other end, said means including a flow restrictor in said housing, said housing and said shaft having flow restricting sleeves carried by said shaft and by said housing in concentric relation and defining a restricted flow path therebetween said means for disengaging said clutch being operable by the difference in pressure caused by said restricted path when fluid is flowing therethrough, said clutch including lugs on one of said sleeves and on one of said shaft and said housing, said one of said sleeves being axially shiftable to disengage said lugs responsive to said differential pressure.

11. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft; fluid passageways through said shaft, bearings between said shaft and said housing to transmit thrust; a fluid passageway through said bearings and said housing; a clutch engageable between said housing and said shaft to couple said housing to a bit for joint rotation; and means to engage and disengage said clutch without increasing the thrust load on said shaft at said other end, said means including a flow restrictor in said housing, said housing and said shaft having flow restricting sleeves carried by said shaft and by said housing in concentric relation and defining a restricted flow path therebetween, said means for disengaging said clutch being operable by the difference in pressure caused by said restricted path when fluid is flowing therethrough; said clutch including lugs on one of said sleeves and on one of said shaft and said housing, said one of said sleeves being axially shiftable to disengage said lugs responsive to said differential pressure, and a spring biasing said one of said sleeves to engage said lugs upon equalization of said differential pressure.

12. A fluid actuated motor assembly including: a housing, a shaft rotatable in said housing, a clutch having one member connected to said housing and another member connected to said shaft, a fluid pressure operated actuator connected to one of said clutch members, a fluid connection between said actuator and said housing to actuate said actuator to disengage said clutch members responsive to fluid flow through said shaft, biasing means to engage said clutch members for mutual rotation of said housing and said shaft responsive to a predetermined diminished flow of fluid through said shaft.

13. The method of connecting a housing to a shaft and bit of a fluid driven motor drill apparatus in a bore hole, comprising; running a fluid driven motor drill into a bore hole on a fluid conducing running pipe, said motor drill including a stator, a housing for said stator, a rotor in said stator, said shaft connected for rotation with said shaft, circulating drilling fluid through said running pipe and said stator and through said housing passing said drilling fluid through a flow restrictor in said housing and causing a pressure drop across said flow restrictor, connecting said motor drill to said running pipe for mutual rotation without increasing said drilling weight by alteration in pressure drop across said flow restrictor.

14. The method of claim 13, wherein said alteration in pressure drop is caused by reducing the circulation of fluid through said running pipe and said motor drill.

15. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft; bearings between said shaft and said housing to transmit thrust; a clutch engageable between said housing and said shaft to couple said housing to the bit for joint rotation; and means to engage and disengage said clutch without increasing the thrust load on said shaft at said other end; said means to engage said clutch including a sring normally acting to engage said clutch, said means to disengage said clutch being responsive to the flow of fluid from said pipe string.

16. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft; bearings between said shaft and said housing to transmit thrust; a clutch engageable between said housing and said shaft to couple said housing to the bit for joint rotation; and means to engage and disengage said clutch without increasing the thrust load on said shaft at said other end; said means to engage said clutch including a spring normally acting to engage said clutch, said means to disengage said clutch being responsive to a difference in fluid pressure in said housing and externally of said housing.

17. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft; bearings between said shaft and said housing to transmit thrust; a clutch engageable between said housing and said shaft to couple said housing to the bit for joint rotation; and means to engage and disengage said clutch without increasing the thrust load on said shaft at said other end; said clutch comprising relatively shiftable members engageable between said shaft and said housing, and a spring biasing one of said members towards the other.

18. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft; bearings between said shaft and said housing to transmit thrust; a clutch engageable between said housing and said shaft to couple said housing to the bit for joint rotation; and means to engage and disengage said clutch without increasing the thrust load on said shaft at said other end; said clutch including a drive ring driven by one of said housing and said shaft and a spring biasing said ring into engagement with the other of said housing and said shaft.

19. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft; bearings between said shaft and said housing to transmit thrust; a clutch engageable between said housing and said shaft to couple said housing to the bit for joint rotation; and means to engage and disengage said clutch without increasing the thrust load on said shaft at said other end; said clutch including a drive ring driven by one of said housing and said shaft and a spring biasing said ring into engagement with the other of said housing and said shaft, said means to disengage said clutch including differential fluid pressure operated actuator means operable when fluid flows through said pipe string.

20. An in-hole motor adapted for connection with a rotatable pipe string and a bit, said assembly comprising: a motor stator including a housing structure connectable at one end to a pipe string; a rotor in said stator;

a drive shaft extending from the other end of said housing and connected at one end of said shaft with said rotor for rotation therewith to drive a drill bit at the other end of said shaft; bearings between said shaft and said housing to transmit thrust; a clutch engageable between said housing and said shaft to couple said housing to the bit for joint rotation; and means to engage and disengage said clutch without increasing the thrust load on said shaft at said other end; said clutch including rods carried by one of said housing and said shaft, and sockets in the other of said housing and said shaft.

21. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft; bearings between said shaft and said housing to transmit thrust; a clutch engageable between said housing and said shaft to couple said housing to the bit for joint rotation; and means to engage and disengage said clutch without increasing the thrust load on said shaft at said other end; said clutch including rods carried by one of said housing and said shaft, and sockets in the order of said housing and said shaft, said means to disengage said clutch including differential fluid pressure operated actuator means operable when fluid flows through said stator.

22. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft; bearings between said shaft and said housing to transmit thrust; a clutch engageable between said housing and said shaft to couple said housing to the bit for joint rotation; and means to engage and disengage said clutch without increasing the thrust load on said shaft at said other end; said housing and said shaft having flow restricting sleeves carried by said shaft and by said housing in concentric relation and defining a restricted flow path therebetween said means for disengaging said clutch being operable by the difference in pressure caused by said restricted path when fluid is flowing therethrough, said clutch including lugs on one of said sleeves and on one of said shaft and said housing, said one of said sleeves being axially shiftable to disengage said lugs responsive to said differential pressure.

23. An in-hole motor adapted for connection with a rotatable pipe string and a bit, said assembly comprising: a motor stator including a housing structure connectable at one end to a pipe string; a rotor in said stator; a drive shaft extending from the other end of said housing and connected at one end of said shaft with said rotor for rotation therewith to drive a drill bit at the other end of said shaft; bearings between said shaft and said housing to transmit thrust; a clutch engageable between said housing and said shaft to couple said housing to the bit for joint rotation; and means to engage and disengage said clutch without increasing the thrust load on said shaft at said other end; said housing and said shaft having flow restricting sleeves carried by said shaft and by said housing in concentric relation and defining a restricted flow path therebetween said means for disengaging said clutch being operable by the difference in pressure caused by said restricted path when fluid is flowing therethrough, said clutch including lugs on one of said sleeves and on one of said shaft and said housing, said one of said sleeves being axially shiftable to disengage said lugs responsive to said differential pressure, and a spring biasing said one of said sleeves to engage said lugs upon equalization of said differential pressure.

* * * * *